US005129839A

United States Patent [19]

VanSkiver

[11] Patent Number: 5,129,839

[45] Date of Patent: Jul. 14, 1992

[54] EXTENSION CORD CONNECTION HOUSING

[75] Inventor: Ralph VanSkiver, Arlington, Tex.

[73] Assignee: Doskocil Manufacturing Company, Inc., Arlington, Tex.

[21] Appl. No.: 799,436

[22] Filed: Nov. 20, 1991

[51] Int. Cl.[5] ..... H01R 13/50

[52] U.S. Cl. ..... 439/367; 439/369

[58] Field of Search ..... 439/367, 369, 368, 371

[56] References Cited

U.S. PATENT DOCUMENTS

| | | | |
|---|---|---|---|
| 2,903,669 | 9/1959 | Gilman et al. | 439/369 |
| 3,344,393 | 9/1967 | Hendee | 439/369 |
| 3,499,102 | 3/1970 | Gillemot et al. | 439/367 X |
| 4,169,643 | 10/1979 | Gallagher | 439/369 |
| 4,221,449 | 9/1980 | Shugart, Jr. | 439/369 |
| 4,643,505 | 2/1987 | House et al. | 439/367 X |
| 4,664,463 | 5/1987 | Carmo | 439/369 |
| 4,749,363 | 6/1988 | Luska et al. | 439/369 X |

*Primary Examiner*—Larry I. Schwartz
*Assistant Examiner*—Kevin J. Carroll
*Attorney, Agent, or Firm*—Andrew J. Dillon

[57] ABSTRACT

A device for maintaining an interconnection between male and female electrical extension cord plugs of a pair of extension cords. A generally elongate housing is provided having an upper half and a lower half which are hingeably coupled together along one edge in an axial direction. A latch is provided for selectively securing and maintaining the upper half and lower half of the housing together in an aubtting relationship, forming an enclosure therein suitable for enclosing an interconnected male and female extension cord plug. A first aperture at one end of the housing is sized to receive an electrical extension cord while retaining a first plug within the housing. A slideably mounted plug retaining bracket is utilized to retain a second plug within the housing and a ratchet arrangement of angled slots and teeth are utilized to permit movement of the plug retaining bracket toward the first aperture while restricting movement in the opposite direction, thereby maintaining an interconnection between male and female extension cord plugs after urging the second plug toward the first plug.

9 Claims, 2 Drawing Sheets

EXTENSION CORD CONNECTION HOUSING

BACKGROUND OF THE INVENTION

1. Field of the Invention

The present invention relates in general to the field of electrical extension cords and in particular to devices for maintaining an interconnection between electrical extension cord plugs. Still more particularly the present invention relates to a device for preventing the accidental disconnection of electrical extension cord plugs.

2. Description of the Prior Art

The interconnection of flexible electrical extension cords to transmit electrical power from a source, such as a household electrical outlet, to an electrical device is very common. In the household environment several extension cords may be interconnected to provide power to a device, such as an electrical lawn mower or electric hedge trimmer for use at a substantial distance from a power outlet. Interconnected extension cords may also be utilized in commercial applications, particularly by construction workers operating hand tools or other devices remotely from a power outlet.

A typical electrical extension cord includes a male and female plug which are interconnected by a flexible extension cord cable. In many extension cords the female plug of one cord extension is connected to the male plug of a second cord by receiving a spade type conductor from the male plug and urging internal conductors into contact therewith. On many occasions, the application of tension to a cable consisting of a connected pair of electrical extension cords will induce separation or disconnection of conductors in the plugs and thereby prevent the transmission of electrical power. This quite naturally results in an inconvenience and expense caused by the necessity to manual reconnect the plugs.

One solution to this problem has been the use of "twist-lock" connectors. These find acceptance in heavy duty industrial and theatrical settings. "Twist-lock" connectors employ special prongs and receptacles which are not compatible with normal home or light industrial wall plugs or with the connections on normally utilized household extension cords. Therefore, this solution, while effective in an industrial setting, will not work in common household applications.

One solution proposed to this problem has been to equip a connection with an appliance or accessory which holds two ends of the connection in an interconnected engagement. U.S. Pat. No. 3,383,639, issued to Anderson et al, discloses a clamp device which fits around two ends of a connection and holds the two plugs in connection. Although this device has the advantage of being easy to utilize, it requires complete removal when the plugs are separated.

U.S. Pat. No. 3,014,194, issued to Berglund, discloses a cable connector protector which is a single body which clamps around a connected set of plugs.

U.S. Pat. No. 3,030,601, issued to Krebs, discloses a very simple device which is a one piece jacket formed of a rubber like material which slips around two connected cables.

U.S. Pat. No. 4,169,643, issued to Gallagher, discloses a mating clip wherein the connected ends of the receptacle and plug are latched together within a closeable container.

Similarly, U.S. Pat. No. 4,643,505, issued to House et al, discloses a device in which latched-together electrical connector plugs are clamped within a housing to secure the connection.

U.S. Pat. No. 4,690,476, issued to Morgenrath, discloses an electrical connector securing system wherein each end of the coupling is equipped with a housing and two housing are held together utilizing straps.

U.S. Pat. No. 4,784,612, issued to Ryan, discloses a pair of housings, one on each half of an electrical connector, which thread together to secure the connector halves in a connected state.

Finally, U.S. Pat. No. 4,940,424, discloses a device including two members, one surrounding a male plug and a second surrounding a female plug. These members are cylindrical and engage one another with protuberances on one member sliding and latching in grooves within the other member.

While the devices disclosed in the above-referenced patents have been effective in certain circumstances, there remains a need for a light weight, inexpensive device which be utilized to maintain the connection between extension cords. In particular, it would be most desirable to provide a device performing this function which is adaptable for use with a wide cross section of the multitude of extension cord designs which are currently available.

SUMMARY OF THE INVENTION

It is therefore one object of the present invention to provide an improvement in the field of electrical extension cords.

It is another object of the present invention to provide an improved device for maintaining an interconnection between electrical extension cord plugs.

It is yet another object of the present invention to provide a device for preventing the accidental disconnection of mated electrical extension cord plugs.

The foregoing objects are achieved as is now described. A device is disclosed for maintaining an interconnection between male and female extension cord plugs of a pair of electrical extension cords. A generally elongate housing is provided having an upper half and a lower half which are hingeable coupled together along one edge in an axial direction. A latch is provided for selectively securing and maintaining the upper half and lower half of the housing together in an abutting relationship, forming an enclosure therein suitable for enclosing an interconnected male and female extension cord plug. A first aperture at one end of the housing is sized to receive an electrical extension cord while retaining a first plug within the housing. A slideably mounted plug retaining bracket is utilized to retain a second plug within the housing and a ratchet arrangement of angled slots and teeth are utilized to permit movement of the plug retaining bracket toward the first aperture while restricting movement in the opposite direction, thereby maintaining an interconnection between male and female extension cord plugs after urging the second plug toward the first plug.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
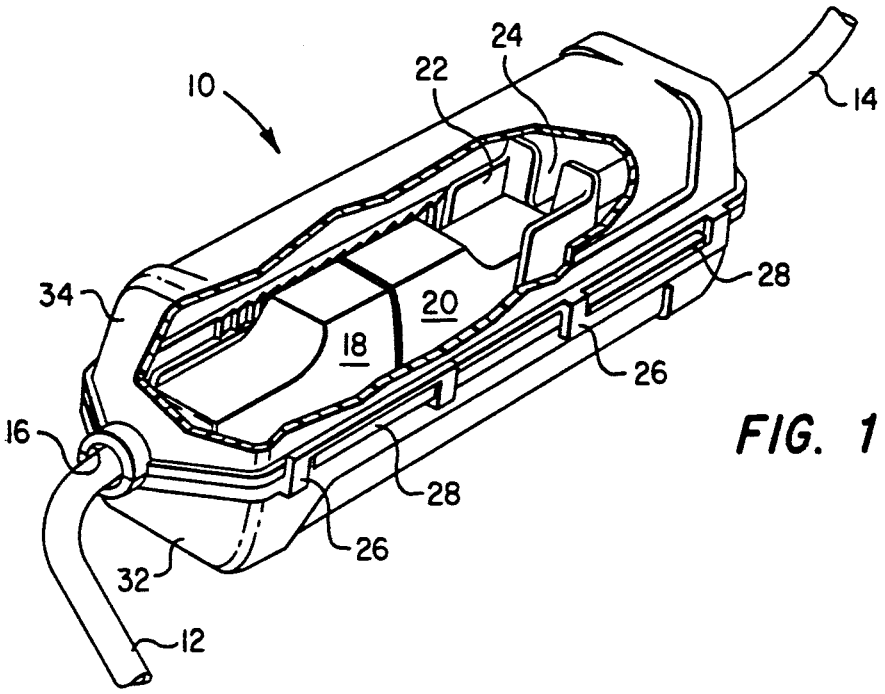
FIG. 1 is partially cutaway view of the extension cord connection housing of the present invention.

With reference now to the Figures and in particular with reference to FIG. 1 there is a depicted a partially cutaway perspective view of electrical extension cord connection housing 10 of the present invention. As illustrated, electrical extension cord connection housing 10 includes a lower half 32 and an upper half 34 which are hingeably coupled together utilizing a live hinge 36 (not shown) as an electrical extension cord 12 and an electrical extension cord 14 may be interconnected by mating plug 18 and plug 20 within electrical extension cord connection housing 10, in a manner which will be explained in greater detail herein.

As illustrated, electrical extension cord connection housing 10 includes a first aperture 16 which is adapted to receive electrical extension cord 12 and retain electrical extension cord plug 18 within electrical extension cord connection housing 10, when lower half of 32 and upper half of 34 of electrical extension cord connection housing 10 are secured in an abutting relation, as depicted.

Similarly, electrical extension cord 14 enters electrical extension connection cord housing 10 via a second aperture 30 (not shown) and electrical extension cord plug 20 is depicted as being retained within a plug retaining bracket 22. Electrical extension cord 14 is received within plug retaining bracket slot 24 and, in a manner which will be explained in greater detail herein, electrical extension cord plug 18 and electrical extension cord plug 20 are retained in an interconnected position as depicted within FIG. 1.

Also depicted within FIG. 1 are two latches 26 which each include an elongate slot therein adapted to mate with an associated tab 28. As illustrated in FIG. 1, one latch 26 is mounted to lower half 32 of electrical extension cord connection housing 10 while a second latch 26 is mounted to upper half 34 of electrical extension cord connection housing 10. In this manner, upper half 34 and lower half 32 of electrical extension cord connection housing 10 may be selectively secured and maintained in a abutting relationship, forming an enclosure therein suitable for enclosing electrical extension plugs 18 and 20 in a mated relationship.

Figure 2:
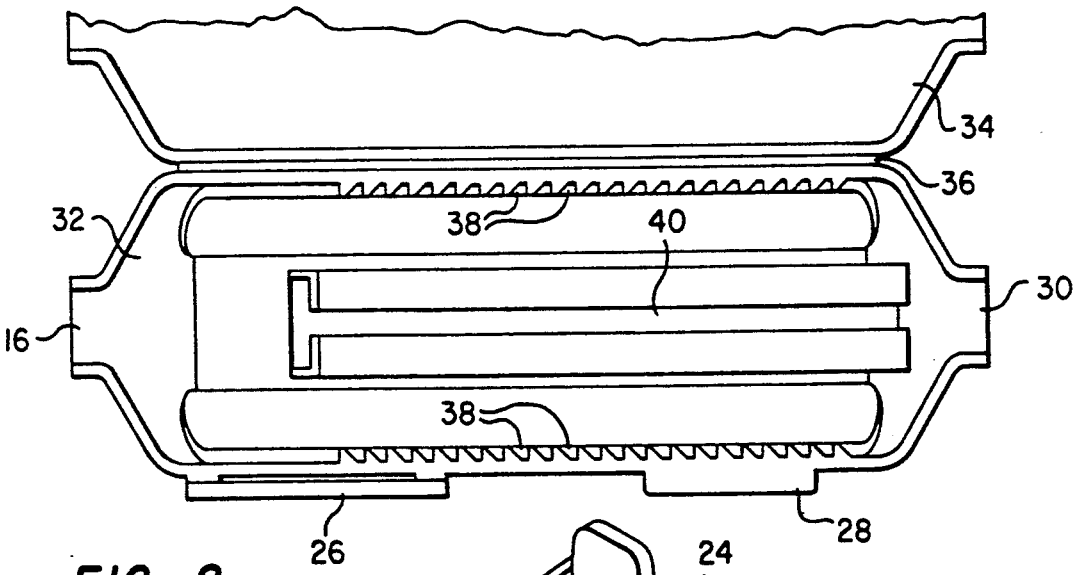
FIG. 2 is plan view of the interior of the lower half of the electrical cord connection housing of the present invention.

Referring now to FIG. 2 there is a depicted a planned view of the interior of lower half 32 of electrical extension cord connection housing 10 of the present invention. As illustrated, upper half 34 and lower half 32 of electrical extension cord connection housing 10 are preferably hingeably coupled together along one edge in an axial direction utilizing live hinge 36. Those skilled in the art will appreciate that electrical extension cord connection housing 10 may be molded of a stet thermoplastic material such as a blend of polypropylene and polyethylene and that live hinge 36 may be formed during this molding process.

An important feature of electrical extension cord connection housing 10 of the present invention is illustrated within FIG. 2 wherein a plurality of angled slots 38 are depicted along each side of lower half 32 of electrical extension cord connection housing 10. As will be explained in greater detail herein, the plurality of angled slots 38 serve to cooperate with a plurality of angled teeth mounted to a plug retaining bracket 22, thereby restricting movement of plug retaining bracket 22 in one direction. Also, depicted within FIG. 2 is axial slot 40 which serves to slideably mount plug retaining bracket 22 in a manner which will be described in greater detail below.

Figure 3:
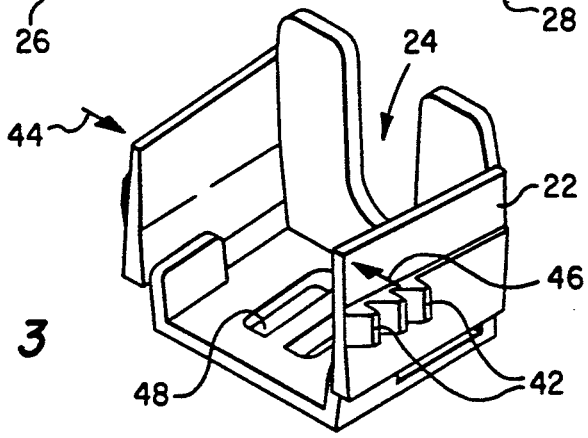
FIG. 3 is a perspective view of a plug retaining bracket which may be utilized within the electrical cord connection housing of the present inventions.

With reference now to FIG. 3 there is depicted a perspective view of plug retaining bracket 22, which may be utilized within electrical extension cord connection housing 10 of the present invention. As illustrated, plug retaining bracket 22 includes a plug retaining bracket slot 24 which is sized to receive an electrical extension cord while retaining an electrical extension cord plug within plug retaining bracket 22. Tab 48, mounted on the lower surface of plug retaining bracket 22, is sized to be received within axial slot 40 (see FIG. 2), thereby permitting plug retaining bracket 22 to be slideably mounted within lower half 32 of electrical extension cord connection housing 10.

An important feature of the present invention is depicted within FIG. 3 wherein a plurality of angled teeth 42 are formed on each side of plug retaining bracket 22. When tab 48 is mounted within axial slot 40 of lower half 32 of electrical extension cord connection housing 10, angled teeth 42 engage selectively with angled slots 38 and, in response to the angled nature thereof, restrict the movement of plug retaining bracket 22 in the direction of aperture 30 while permitting movement of plug retaining bracket 22 toward aperture 16 under moderate manual pressure.

Those skilled in the art will appreciate that by constructing plug retaining bracket 22 of a suitably pliable plastic material, plug retaining bracket 22 may be manually distorted in the direction indicated at arrows 44 and 46, such that angled teeth 42 may be temporarily disengaged from angled slots 38, permitting plug retaining bracket 22 to be moved in the direction of aperture 30 for initial adjustment.

Figure 4:
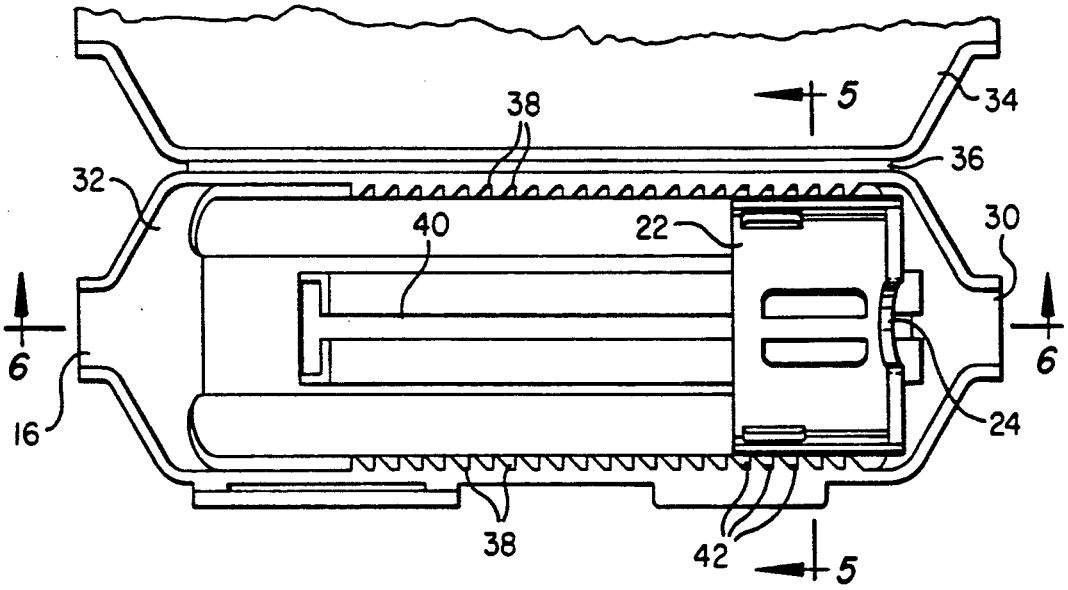
FIG. 4 is a plan view of the interior of the lower half of the electrical cord connection housing of the present invention depicting a plug retaining bracket mounted therein.

Referring now to FIG. 4 there is a depicted a plan view of the interior of lower half 32 of electrical extension cord connection housing 10 of the present invention, depicting plug retaining bracket 22 mounted therein. As is illustrated, plug retaining bracket 22 is mounted within lower half 32 of electrical cord connection housing 10 by inserting tab 48 within axial slot 40. In the manner depicted within FIG. 4, angled teeth 42 may be seen to have engaged a selected number of angled slots 38 within lower half 32 of electrical cord connection housing 10, thereby restricting movement of plug retaining bracket 22 in the direction of aperture 30 while permitting movement of plug retaining bracket 22 in the direction of aperture 16, due to the angled nature of the interface between angled teeth 42 and angled slots 38.

Upon reference to the foregoing those skilled in the art will appreciated that either electrical connector plug from an electrical extension cord may be placed within lower half 32 of electrical extension cord connection housing 10 by placing the electrical extension cord within aperture 16 and retaining either the male or female plug within lower half 32 of electrical extension cord connection housing 10 in the vicinity of aperture 16. A second electrical plug may be placed within plug retaining bracket 22 with the associated electrical extension cord being received within plug retaining bracket slot 24 and aperture 30. Thereafter, by manually urging bracket 22 toward aperture 16 the plug contained within plug retaining bracket 22 may be selectable mated with the plug retained within lower half 32 of electrical extension cord connection housing 10 in the vicinity of aperture 16, and the interconnection created thereby maintained by selectively securing and maintaining upper half 34 and lower half 32 in an abutting relationship in the manner depicted within FIG. 1.

Figure 5:
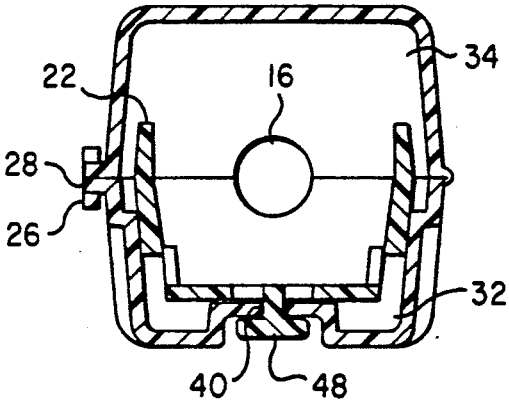
FIG. 5 is a sectional view of the electrical cord connection housing of the present invention in a closed position, taken along line 5—5 of FIG. 4.

With reference now to FIG. 5 there is depicted a sectional view of electrical extension cord connection housing 10 of the present invention in a closed position, taken along line 5—5 of FIG. 4. As illustrated within FIG. 5 the relationship of tab 48 an axial slot 40 may be seen. By inserting tab 48 within axial slot 40 it may be seen that plug retaining bracket 22 is slideably mounted within lower half of 32 of electrical cord connection housing 10.

Figure 6:
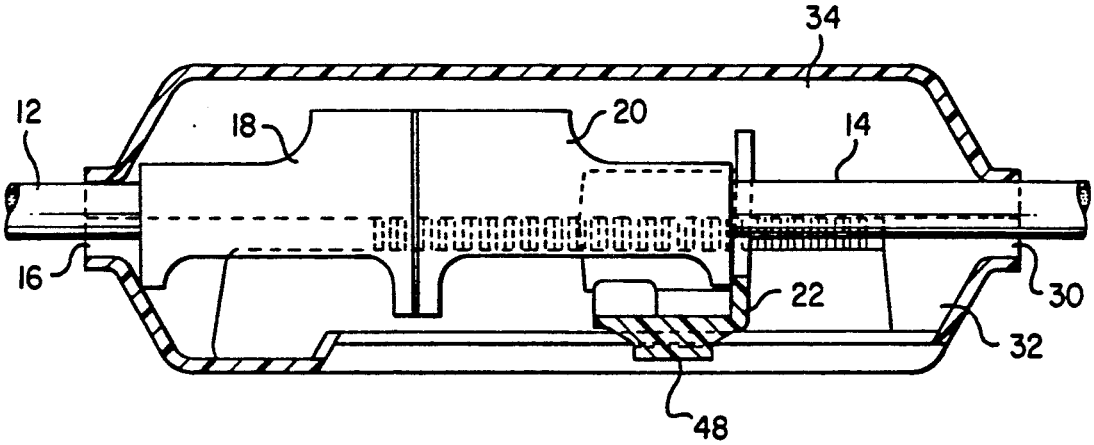
FIG. 6 is a sectional view of the electrical cord connection housing of the present invention, taken along line 6—6 of FIG. 4, depicting a electrical extension cord connected therein.

Finally, referring to FIG. 6 there is depicted a sectional view of electrical extension cord connection housing 10 of the present invention, taken along line 6—6 of FIG. 4, depicting an electrical cord connection therein. As may be seen, plug 18 is retained within electrical extension cord connection housing 10 in the vicinity of aperture 16 by threading electrical extension cord 12 through aperture 16. Electrical extension cord plug 20 is then retained within plug retaining bracket 22, by threading electrical extension cord 14 through plug retaining bracket slot 24 and aperture 30. Thereafter, plug retaining bracket 22 may be manually urged toward aperture 16 until such time as mated electrical extension cord plug 18 and electrical extension cord plug 20 are securely held.

As previously described, the interaction of angled teeth 42 and angled slots 38 will then serve to retain electrical extension cord plug 20 in the mated relationship depicted, with electrical extension cord 18 within electrical extension cord connection housing 10, thereby assuring the connection there between and preventing accidental disconnection thereof.

As described above, adjustments for alternate electrical extension cord plugs may be created by manually distorting plug retaining bracket 22 in the directin indicted at arrows 44 and 46 of FIG. 3, permitting plug retaining bracket 22 to be selectively urged in the direction of aperture 30.

Upon reference to the foregoing those skilled in the art will appreciate that the applicant herein has created a device for maintaining an interconnection between a first plug and a second plug of a pair electrical extension cords which protects the interconnection therebetween by enclosing that interconnection within a housing and which may adjustably accommodate various sized electrical extension cord plugs without relying upon separate elements which may become lost or damaged, rendering electrical extension cord connection housing 10 useless.

While the invention has been shown in only one of its forms, it is not thus limited but is susceptible to various changes and modifications without departing from the spirit thereof.

What is claimed is:

1. A device for maintaining an interconnection between a first plug and a second plug of a pair of electrical extension cords, said device comprising:

a generally elongate housing having an upper half and a lower half hingeably coupled together along one edge in an axial direction;

latch means for selectively securing and maintaining said upper half and said lower half in an abutting relationship forming an enclosure therein suitable for enclosing an interconnected first plug and second plug of a pair of electrical extension cords;

a first aperture axially located within said generally elongate housing and sized to surround an electrical extension cord while retaining a first plug within said generally elongate housing while said upper half and lower half are maintained in an abutting relationship;

plug retaining means slideably mounted within said generally elongate housing, said plug retaining means having a slot therein sized to receive an electrical extension cord while retaining a second plug while said upper half and lower half are maintained in an abutting relationship; and ratchet means formed on said housing and said plug retaining means for permitting said plug retaining means to be slideably adjusted towards said first aperture while restricting movement of said plug retaining means away from said first aperture wherein an interconnection between said first plug and said second plug may be maintained.

2. The device for maintaining an interconnection between a first plug and a second plug of a pair of electrical extension cords according to claim 1, wherein said generally elongate housing is substantially rectangular in shape.

3. The device for maintaining an interconnection between a first plug and a second plug of a pair of electrical extension cords according to claim 1, wherein said generally elongate housing is constructed of molded thermoplastic.

4. The device for maintaining an interconnection between a first plug and a second plug of a pair of electrical extension cords according to claim 1, wherein said latch means comprises at least one latch mounted to said upper half of said generally elongate housing and having an elongate slot therein and at least one elongate tab mounted to said lower half of said generally elongate housing, said at least one elongate tab sized to be received within said elongate slot.

5. The device for maintaining an interconnection between a first plug and a second plug of a pair of electrical extension cords according to claim 1, further including a second aperture axially located within said generally elongate housing opposite said first aperture.

6. The device for maintaining an interconnection between a first plug and a second plug of a pair of electrical extension cords according to claim 1, wherein said plug retaining means is slideably mounted within said lower half of said generally elongate housing.

7. The device for maintaining an interconnection between a first plug and a second plug of a pair of electrical extension cords according to claim 6, wherein said ratchet means includes a plurality of angled slots formed on said lower half of said generally elongate housing and a plurality of angled teeth formed on said plug retaining means and adapted to engage said plurality of angled slots.

8. The device for maintaining an interconnection between a first plug and a second plug of a pair of electrical extension cords according to claim 7, wherein said plug retaining means is constructed of a pliable plastic material wherein said plug retaining means may be manually distorted in order to selectively disengage said plurality of angled teeth from said plurality of angled slots.

9. The device for maintaining an interconnection between a first plug and a second plug of a pair of electrical extension cords according to claim 1, wherein said upper half and lower half of said generally elongated housing are hingeably coupled together utilizing a live hinge.

* * * * *